US006818889B1

(12) United States Patent
Sheehan et al.

(10) Patent No.: US 6,818,889 B1
(45) **Date of Patent: *Nov. 16, 2004**

(54) LAMINATED LENS FOR FOCUSING IONS FROM ATMOSPHERIC PRESSURE

(76) Inventors: Edward W. Sheehan, 655 William Pitt Way, Pittsburgh, PA (US) 15238; Ross C Willoughby, 655 William Pitt Way, Pittsburgh, PA (US) 15238

( * ) Notice: Subject to any disclaimer, the term of this patent is extended or adjusted under 35 U.S.C. 154(b) by 0 days.

This patent is subject to a terminal disclaimer.

(21) Appl. No.: 10/449,147

(22) Filed: May 31, 2003

Related U.S. Application Data

(60) Provisional application No. 60/384,869, filed on Jun. 1, 2002.

(51) Int. Cl.[7] ..... B01D 59/44
(52) U.S. Cl. ..... 250/288; 250/281; 250/286
(58) Field of Search ..... 250/288, 281, 250/286

(56) References Cited

U.S. PATENT DOCUMENTS

| | | | | |
|---|---|---|---|---|
| 4,209,696 A | | 6/1980 | Fite | |
| 4,531,056 A | | 7/1985 | Labowsky et al. | |
| 4,542,293 A | | 9/1985 | Fenn et al. | |
| 4,999,492 A | | 3/1991 | Nakagawa | |
| 5,412,208 A | | 5/1995 | Covey et al. | |
| 5,436,446 A | | 7/1995 | Jarrell et al. | |
| 5,559,326 A | | 9/1996 | Goodley et al. | |
| 5,747,799 A | | 5/1998 | Franzen | |
| 5,756,994 A | | 5/1998 | Bajic | |
| 5,965,884 A | | 10/1999 | Laiko et al. | |
| 6,060,705 A | * | 5/2000 | Whitehouse et al. | 250/288 |
| 6,207,954 B1 | | 3/2001 | Andrien et al. | |
| 6,239,428 B1 | | 5/2001 | Kunz | |
| 6,610,986 B2 | | 8/2003 | Hartley | |

FOREIGN PATENT DOCUMENTS

| | | |
|---|---|---|
| JP | 4215329 | 8/1992 |
| JP | 10088798 | 4/1998 |
| WO | WO-99/63576 | 12/1999 |
| WO | WO 03/010794 A2 | 2/2003 |

OTHER PUBLICATIONS

Potjewyd, J., "Focusing of ions in atmospheric pressure gases using electrostatic fields," Ph. D. Thesis, University of Toronto (1983).

Hartley, F.T. et al, "NBC detection in air and water," Micro/Nano 8, pp. 1, 2, and 8 (Dec. 2003).

* cited by examiner

*Primary Examiner*—John R. Lee
*Assistant Examiner*—Zia R. Hashmi

(57) ABSTRACT

A thin laminated high transmission electro-optical lens populated with a plurality of apertures in communication with its laminates used to improve the collection, focusing, and selection of ions generated from atmospheric pressure sources, such as electrospray, atmospheric pressure chemical ionization, inductively coupled plasma, discharge, photoionization and atmospheric pressure matrix assisted laser desorption ionization. The laminated lens is made of alternating layers of electrically insulating and metal laminates. The geometry of the lens may be planar or shaped into various curve shapes, any of which act to optimize the direct current (DC) electric field geometries and strengths across the lens for transferring virtually all the ions from the ion source into an ion-focusing region. Embodiments of this invention are methods and devices for improving sensitivity of mass spectrometry when coupled to atmospheric pressure ionization sources.

30 Claims, 14 Drawing Sheets

Figure 1A:
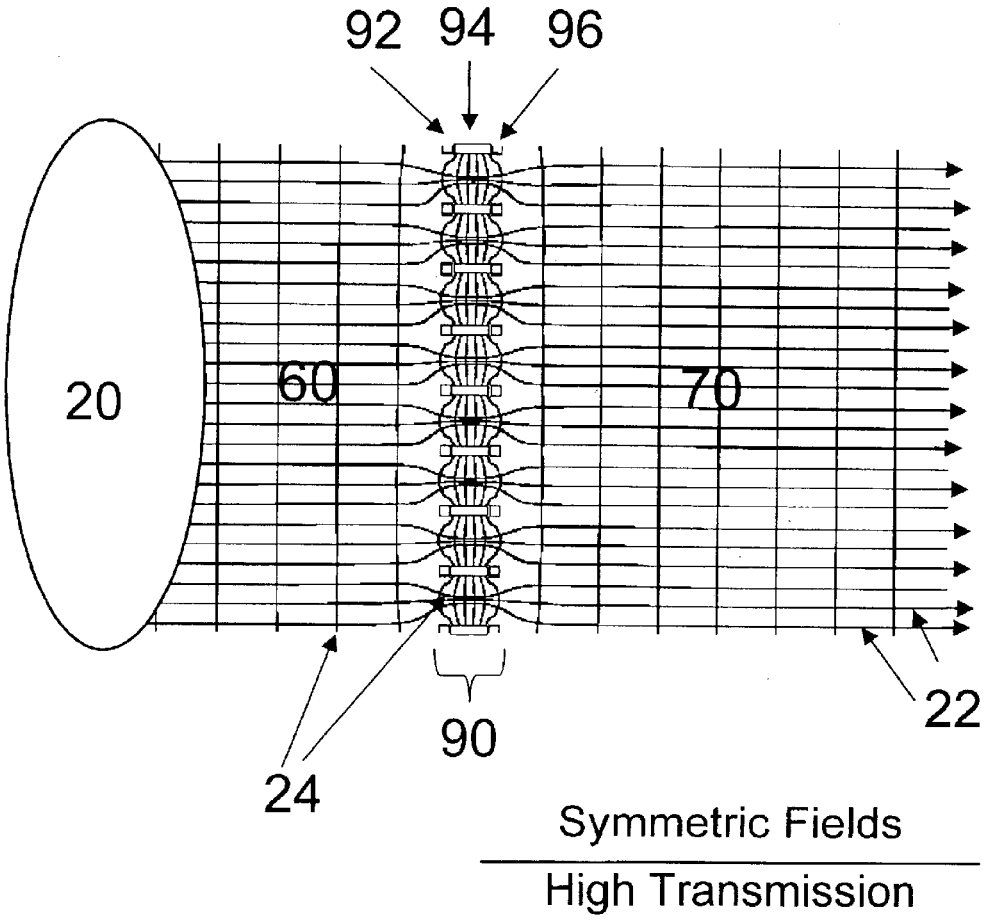

Asymmetric Fields
With Concurrent Flow

Good Transmission

Hemispherical

4A.

Conical

4B.

Tubular

4C.

Planar

4D.

LAMINATED LENS FOR FOCUSING IONS FROM ATMOSPHERIC PRESSURE

CROSS-REFERENCE TO RELATED APPLICATION

This application claims the benefit of Provisional Patent Application Ser. No. 60/384,869, filed 2002, Jun. 1st. This application is related to Provisional Patent Application Ser. No. 60/210,877, filed Jun. $9^{th}$, 2000 now application Ser. No. 09/877,167, Filed Jun. $8^{th}$, 2001.

GOVERNMENT SUPPORT

The invention described herein was made in the course of work under a grant from the Department of Health and Human Services, Grant Number: 1 R43 RR143396-1.

SEQUENCE LISTING OR PROGRAM

Not Applicable

BACKGROUND

Field of Invention

This invention relates to methods and devices for improved collection and focusing of ions generated at or near atmospheric pressure for introduction into the mass spectrometer, ion mobility or ion and charged particle or droplet deposition onto surfaces.

BACKGROUND

Description of Prior Art

The generation of ions at atmospheric pressure is accomplished by a variety of means; including, electrospray (ES), atmospheric pressure chemical ionization (APCI), atmospheric pressure matrix assisted laser desorption ionization (MALDI), discharge ionization, $^{63}$Ni sources, inductively coupled plasma ionization, and photoionization. A general characteristic of all these atmospheric sources is the dispersive nature of the ions once produced. Needle sources such as electrospray and APCI disperse ions radially from the axis in high electric fields emanating from needle tips. Aerosol techniques disperse ions in the radial flow of gases emanating from tubes and nebulizers. Even desorption techniques such as atmospheric pressure MALDI will disperse ions in a solid angle from a surface. The radial cross-section of many dispersive sources can be as large as 5 or 10 centimeters in diameter. As a consequence of a wide variety of dispersive processes, efficient sampling of ions from atmospheric pressure sources to small cross-sectional targets or through small cross-sectional apertures and tubes (usually less than 1 mm) into a mass spectrometer becomes quite problematic. This is particularly amplified if the source on ions is removed from the regions directly adjacent to the aperture.

The simplest approach to sampling dispersive atmospheric sources is to position the source on axis with a sampling aperture or tube. The sampling efficiency of simple plate apertures is generally less than 1 ion in $10^4$. Devices developed by Fite (U.S. Pat. No. 4,209,696) used pinhole apertures in plates with electrospray. Devices developed by Laiko and Burlingame (W.O. Pat. No. 99/63576 and U.S. Pat. No. 5,965,884) used aperture plates with atmospheric pressure MALDI. An atmospheric pressure source by Kazuaki et al (Japan Pat. No. 04215329) is also representative of this inefficient approach. This general approach in severely restricted by the need for precise aperture alignment and source positioning and very poor sampling efficiency.

A wide variety of source configurations utilize conical skimmer apertures in order to improve collection efficiency over planar devices. This approach to focusing ions from atmospheric sources is limited by the acceptance angle of the field generated at the cone. Generally, source position relative to the cone is also critical to performance, although somewhat better than planar apertures. Conical apertures are the primary inlet geometry for commercial ICP/MS with closely coupled and axially aligned torches. Examples of conical-shaped apertures are prevalent in ES and APCI (U.S. Pat. No. 5,756,994), and ICP (U.S. Pat. No. 4,999,492) inlets. As with planar apertures, source positioning relative to the aperture is critical to performance and collection efficiency is quite low.

One focusing alternative utilizes a plate lens with a large hole in front of an aperture plate or tube for transferring sample into the vacuum system. The aperture plate is generally held at a high potential difference relative to the plate lens. The configuration creates a potential well that penetrates into the source region and has a significant improvement in collection efficiency relative to the plate or cone apertures. This configuration has a clear disadvantage in that the potential well resulting from the field penetration is not independent of ion source position, or potential. High voltage needles can diminish this well. Off-axis sources can affect the shape and collection efficiency of the well. Optimal positions are highly dependent upon both flow (gas and liquid) and voltages. They are reasonable well suited for small volume sources such as nanospray. Larger flow sources become less efficient and problematic. Because this geometry is generally preferential over plates and cones, it is seen in most types of atmospheric source designs. We will call this approach the "Plate-well" design which is reported with apertures by Labowsky et al. (U.S. Pat. No. 4,531,056), Covey et al. (U.S. Pat. No. 5,412,209) and Franzen (U.S. Pat. No. 5,747,799). There are also many Plate-well designs with tubes reported by Fenn et al. (U.S. Pat. No. 4,542,293), Goodley et al. (U.S. Pat. No. 5,559,326), and Whitehouse et al. (U.S. Pat. No. 6,060,705).

Several embodiments of atmospheric pressure sources have incorporated grids in order to control the sampling. Jarrell and Tomany (U.S. Pat. No. 5,436,446) utililized a grid that reflected lower mass ions into a collection cone and passed large particles through the grid. This modulated system was intended to allow grounded needles and float the grid at high alternating potentials. This device had limitations with duty cycle of ion collection in a modulating field (non-continuous sample introduction) and spatial and positioning restrictions relative to the sampling aperture. Andrien et al (U.S. Pat. No. 6,207,954 B1) used grids as counter electrodes for multiple corona discharge sources configured in geometries and at potentials to generated ions of opposite charge and monitor their interactions and reactions. This specialized reaction source was not configured with high field ratios across the grids and was not intended for high transmission and collection, rather for generation of very specific reactant ions. An alternative atmospheric pressure device by Yoshiaki (Japan Pat. No. 10088798) utilized hemispherical grids in the second stage of pressure reduction. Although the approach is similar to the present device in concept, it is severely limited by gas discharge that may occur at low pressures if higher voltages are applied to the electrodes and most of the ions are lost at the cone-aperture from atmospheric pressure into the first pumping stage.

Grids are also commonly utilized for sampling ions from atmospheric ion sources utilized in ion mobility spectrometry (IMS). Generally, for IMS analysis ions are pulsed through grids down a drift tube to a detector as shown in Kunz (U.S. Pat. No. 6,239,428B1). Great effort is made to create planar plug of ions in order to maximize resolution of components in the mobility spectrum. These devices generally are not continuous, nor do they require focusing at extremely high compression ratios.

SUMMARY

Figure 5A:
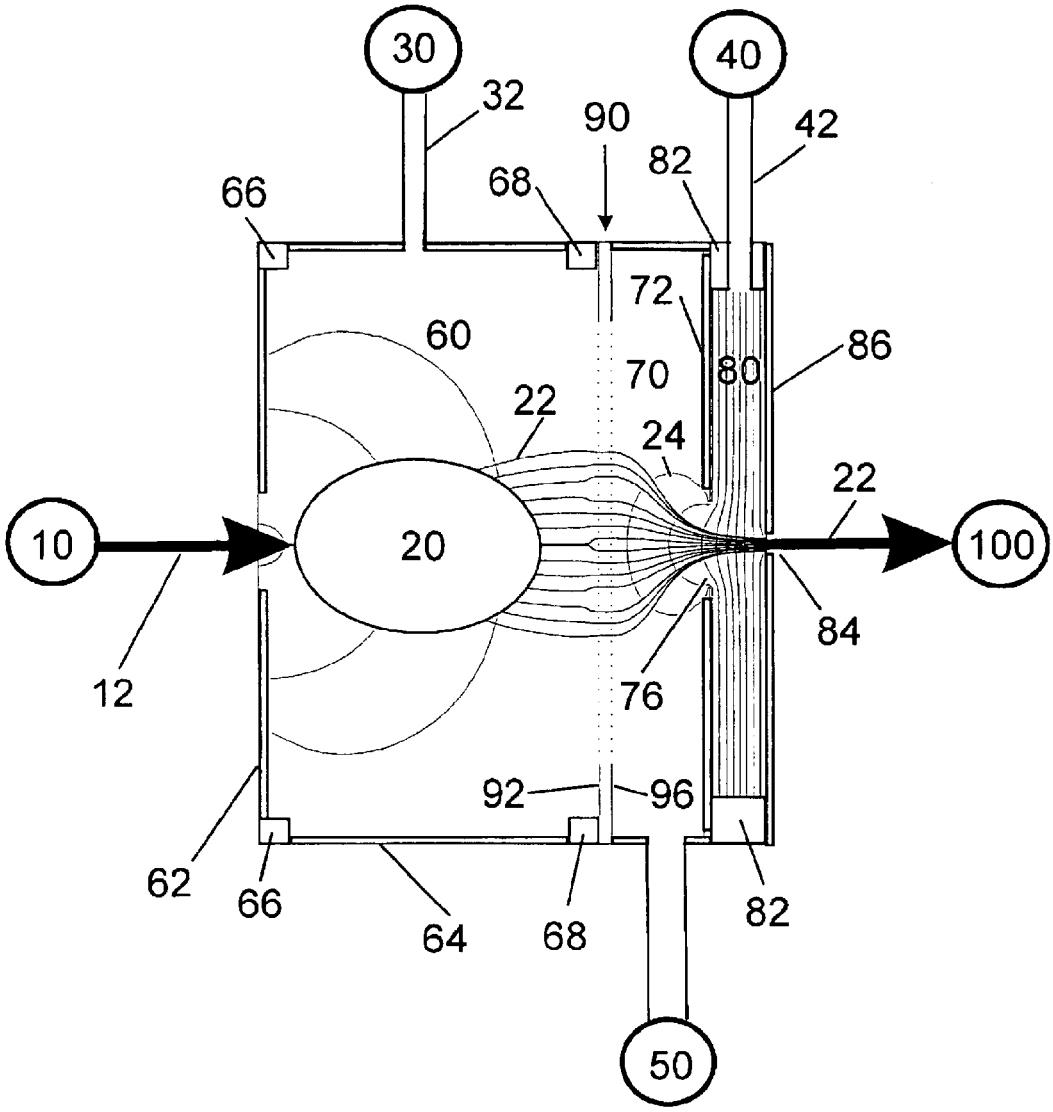

A preferred embodiment of the invention is the configuration of a Laminated High Transmission Element (L-HTE) (as shown in FIG. 5A), comprising an electrical insulating base, and a layer of conducting meshed-surfaces laminated on both sides. The L-HTE is configured downstream from any of a variety of atmospheric pressure sources and upstream from an Inner Field-Shaping Electrode and a conducting collector surface (aperture plate or tube). Ions generated in a relatively large volumetric area of an atmospheric pressure source are attracted toward the top surface of the L-HTE by an attracting potential relative to the source region.

The field ratio, the field strength on the source side of the high transmission element relative to the collector side is maintained at a lower value (generally 1–10× less) than the field strength equidistant to the collector side of the L-HTE. In this operating condition, the field from the collector side of the L-HTE penetrates into the source side of the L-HTE and accelerates appreciably all of the ions through the openings in the L-HTE surface. Typically, the field ratio value is calculated at a distance of several opening diameters away from the surface. A good value of a field ratio is greater than 10.

The L-HTE is typically manufactured so to allow ions to pass easily through the L-HTE surface. This entails having a L-HTE with a low depth aspect ratio, referring to the ratio of the dimension of the openings to the thickness of the L-HTE surface; where the thickness of the insulating base and metal laminates are as thin as mechanically possible. In addition, the openness of the L-HTE is also important. Typically the openness, the ratio of the dimension of the opening to the entire surface area should be as large as possible to allow the field from the metal laminated on the collector side to penetrate through the metal laminated on the source side of the L-HTE and into the source side several opening diameters away from the source side surface of L-HTE.

The focusing side metal laminate of the L-HTE and the inner field-shaping electrode are held at approximately the same potential relative to the collector surface which is held at extremely high potential difference to attract virtually all ions that cross the L-HTE, through a relatively large aperture in the inner field-shaping electrode, onto the collector surface (or through an aperture into the vacuum). The combination of L-HTE shape, Inner Field-shaping Electrode aperture size, and potential difference (between the HTE and the collector) affect substantial compression of the dispersed ions into a small cross-sectional beam at the collector. When this beam is precisely aligned with a vacuum sampling aperture into a mass spectrometer, very high sensitivities are achieved.

The physical separation of the ionization source region from the deep potential-well focusing region by the L-HTE solves many of the efficiency problems associated with conventional approaches to ion collection at atmospheric pressure. With the present invention, dispersed ions are not required to be focused to a small diameter in the ion source region, rather, they are required to drift toward a relatively large front surface of the L-HTE. In this way all ions from a given source can be collected across an appropriately sized and shaped L-HTE surface, then focused in the high field of the focusing well.

OBJECTS AND ADVANTAGES

One object of the present invention is to increase the collection efficiency of ions and/or charged particles at a collector, or through an aperture or tube into a vacuum system, by creating a very small cross-sectional area beam of ions and/or charged particles from highly dispersed atmospheric pressure ion sources. Another object of the present invention is to increase the transmission efficiency of ions from atmospheric pressure ion sources to a target collector, or through an aperture or tube. The present invention has a significant advantage over prior art in that the use of a Laminated High Transmission Element (L-HTE) to separate the regions of ion generation from ion focusing allows precise shaping of fields in both regions. Ions can be generated in large ion source regions without losses to walls. Droplets have longer time to evaporate and/or desorb ions without loss from the sampling stream. Source temperatures can be lower because rapid evaporation is not required. This can prevent thermal decomposition of some labile compounds. Counter electrodes for electrospray needles do not have to be the plate lens as practices with most convention sources or even the L-HTE. The aerosol can be generated remotely and ions can be allowed to drift toward the L-HTE.

Another object of the present invention is to have collection efficiency be independent of ion source position relative to the collection well. With the present invention there is no need for precise mechanical needle alignment or positioning relative to collectors, apertures, or tubes invention. Ions generated at any position in the ion source region are transmitted to the collector, aperture, or tube with similar efficiency. No existing technology has positional and potential independence of the source. The precise and constant geometry, and alignment of the focusing well with sampling apertures will not change with needle placement. The fields inside (focusing side) the well will not change, even if they change outside (source side).

Another object of the present invention is the independence of ion source type. This device is capable of transmission and collection of ions from any atmospheric (or near atmospheric) source; including, electrospray, atmospheric pressure chemical ionization, atmospheric pressure MALDI (laser desorption), inductively coupled plasma, discharge sources, $^{63}$Ni sources, spray ionization sources, induction ionization sources and photoionization sources. The device is also capable of sampling ions of only one polarity at a time, but with extremely high efficiency.

Another object of the present invention is to efficiently collect and/or divert a flow of ions from more than one source. This can be performed in a simultaneous fashion for introduction of mass calibrants from a separate source and analytes from a different source at a different potential; conversely, it can be performed sequentially as is typical with multiplexing of multiple chromatographic streams introduced into one mass spectrometer.

Another object of the present invention is to efficiently transmit ions to more than one target position. This would have the utility of allowing part of the sample to be collected on a surface while another part of the sample is being introduced through an aperture into a mass spectrometer to be analyzed.

Another object of the present invention is to improve the efficiency of multiplexed inlets from both multiple macroscopic sources and micro-chip arrays, particularly those developed with multiple needle arrays for electrospray. Position independence of this invention make it compatible with a wide variety of needle array technologies and multi-well plates for surface desorption techniques.

Another object of the present invention is to remove larger droplets and particles from aerosol sources with a counter-flow of gas to prevent contamination of apertures, tubes, and vacuum components.

Another object of the present invention is to collect all the ions or charged particles or droplets at the outer surface (upstream side) of the L-HTE but to also be able to selectively and spatially sample a select group of ions through the surface. Allowing the efficient application (deposition) of charged compounds on a surface in patterns determined by the shape of the L-HTE, whether the opening permits the transfer of the charged compounds, or by the shape and size of the openings.

Another objective of the present invention is that the precise alignment of the individual openings of the L-HTE with a combination of electrostatic potentials and gas flows, both concurrent and countercurrent, substantially all of the charged compounds can be transferred through the surface.

An advantage of the present device is the independence of collection efficiency of a source of ions from the sampling efficiency of the ions into a gas-phase ion analyzer. Multiple sources are able to be uniformly collected with this invention. Multiple focal points can also be configured if there is need to collect part of the sample and analyze another part.

An additional advantage of the present device is that the addition of gas flow, concurrent and countercurrent to the motion of the ions, provides additional focusing to the ions passing through the L-HTE. As the ions move through the L-HTE a countercurrent flow of gas focuses the ions toward the center of the openings, away from surfaces, and as the ions exit the openings a concurrent flow of gas prevents their radial dispersion focusing the ions axially; whereby the electrostatic direct current potential ratio across the L-HTE can be less than 1.

DRAWING FIGURES

In the drawings, closely related figures have the same number but different alphabetic suffixes.

Figure 1B:
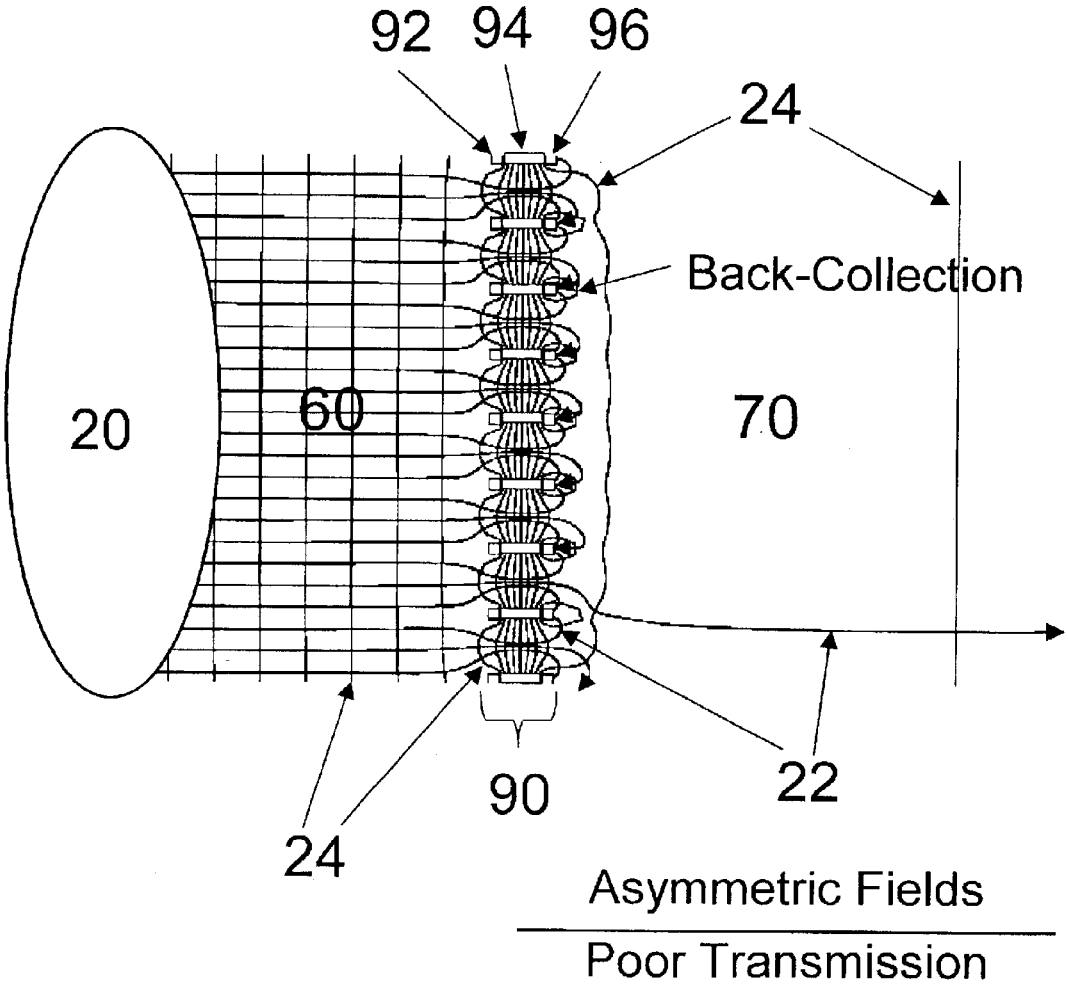
Figure 1C:
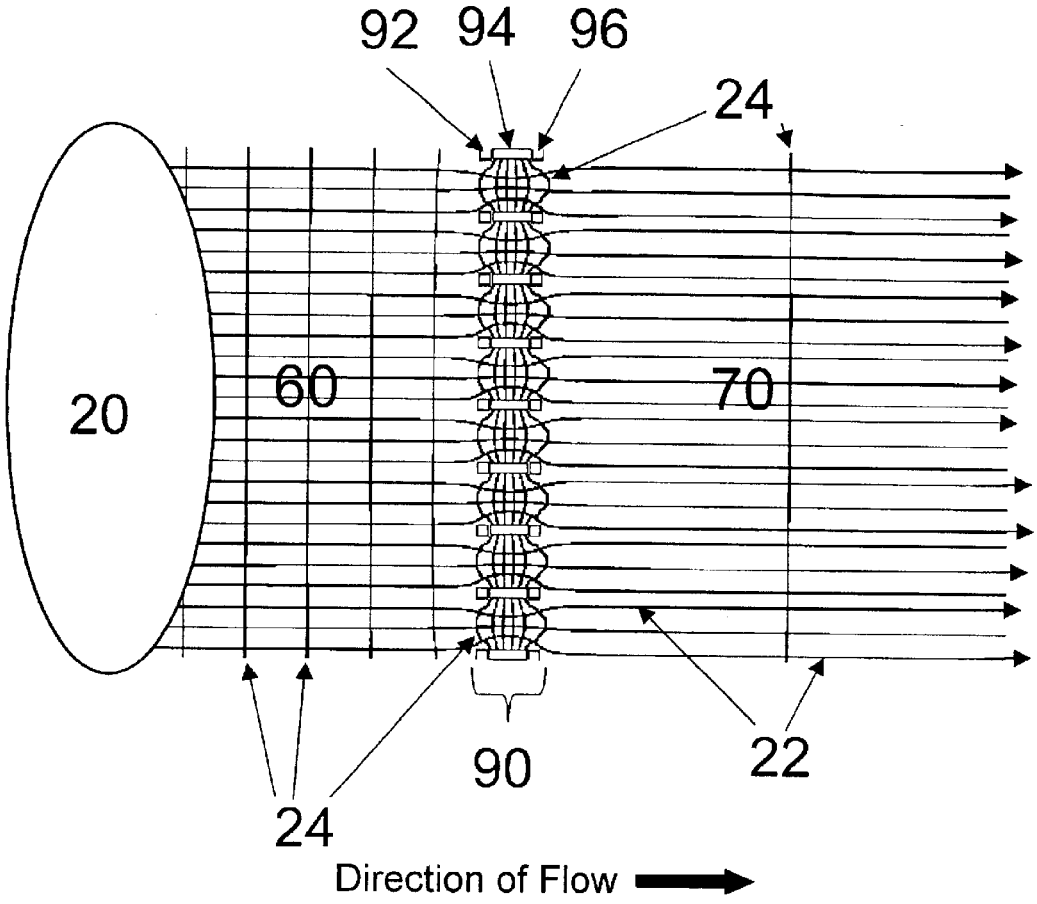

FIGS. 1A to 1C show cross-sectional illustrations of a planar laminated high-transmission element (L-HTE) configuration consisting of two metal laminates with three alternative operating modes; namely, (A) a symmetric laminate in transmission mode with relatively equal fields on either side of laminate surface, (B) a symmetric laminate in back-collection mode due to high relative field on ion source side of laminate surface, and (C) an asymmetric laminate with relatively equal fields on either side of surface and concurrent flow to compensate for asymmetric field penetration.

Figure 2A:
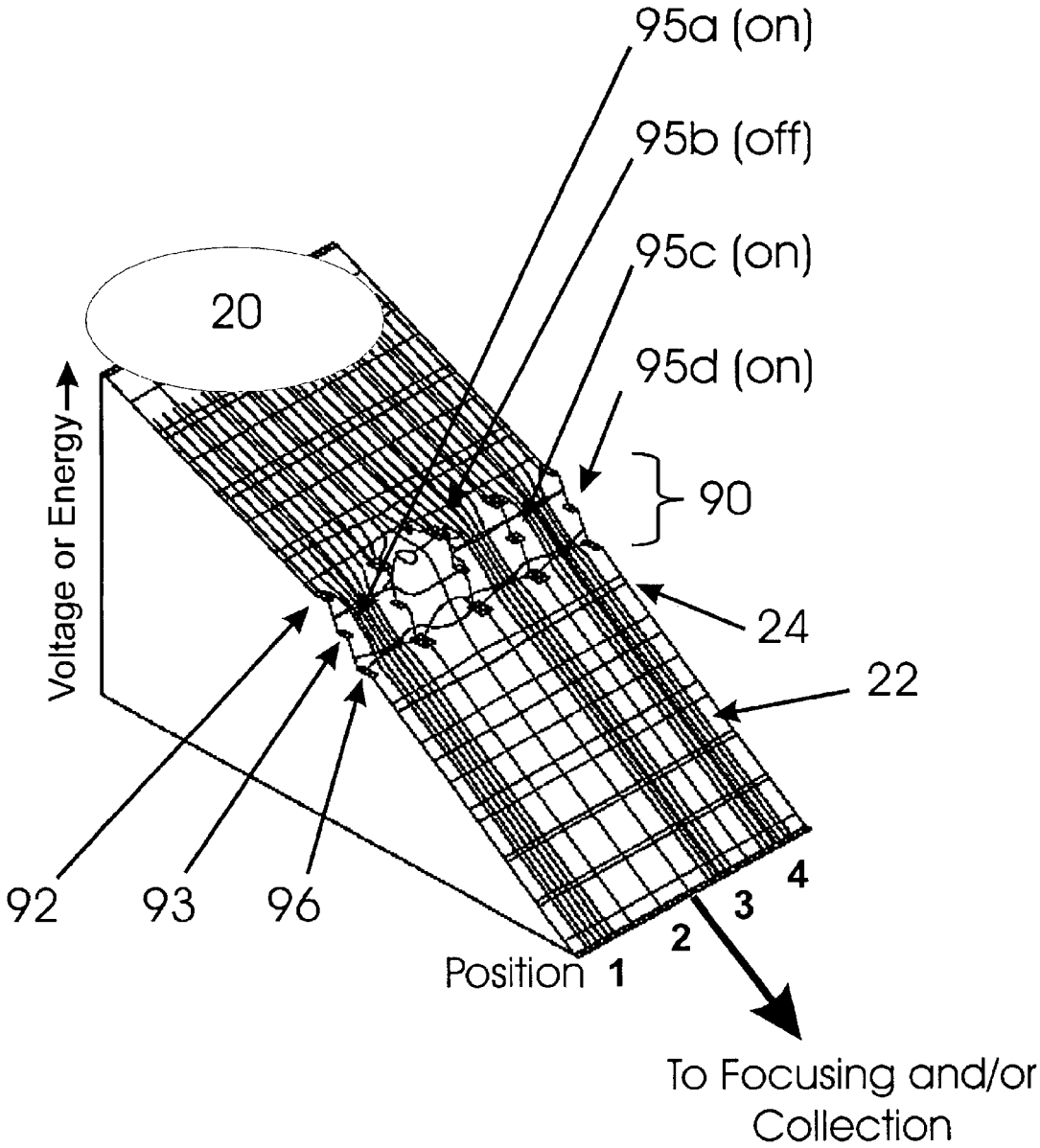
Figure 2B:
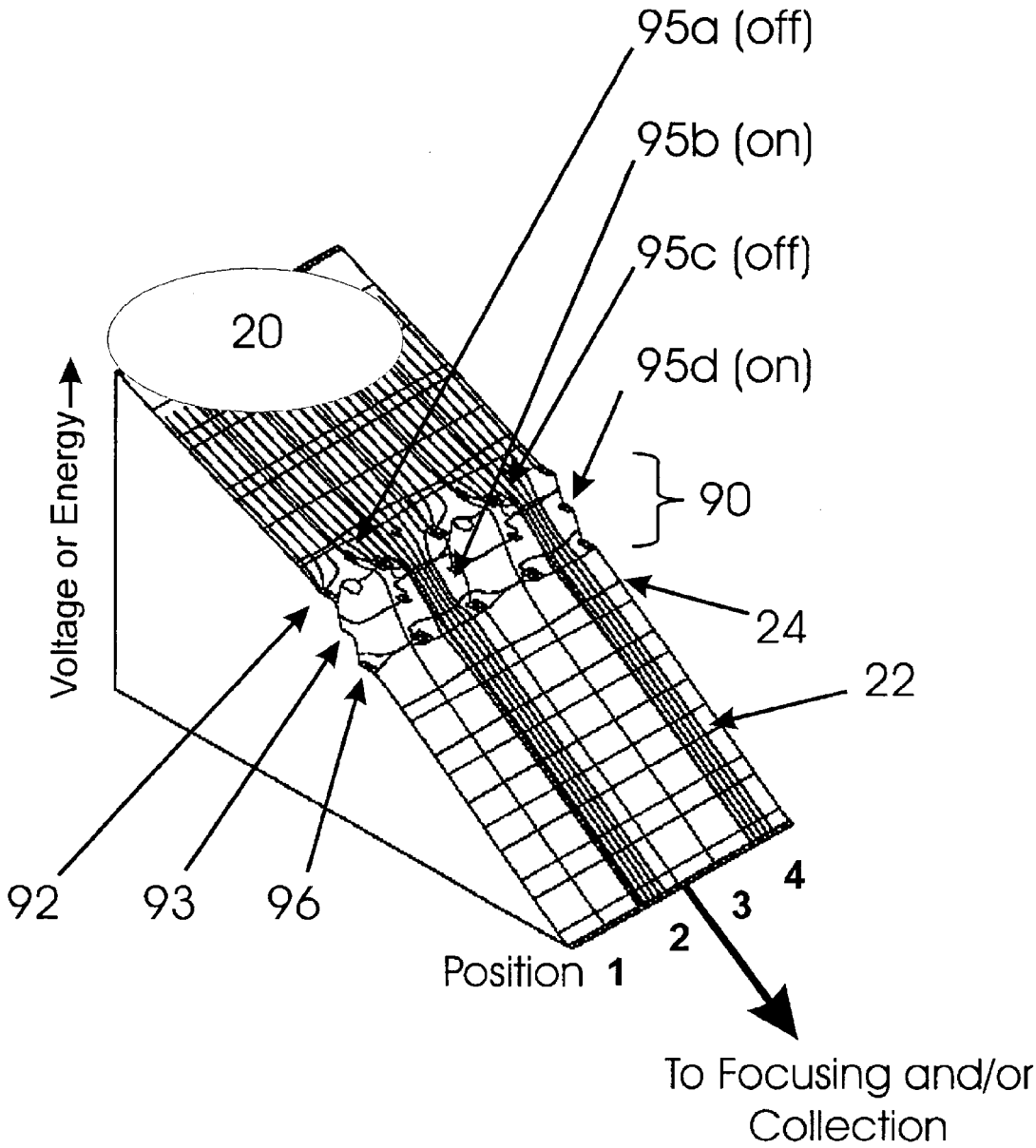

FIGS. 2A and 2B show a potential energy surface of a laminated high-transmission element (L-HTE) comprised of three metal laminates, (A) showing position 2 closed and positions 1, 3, and 4 open to ion flow, and (B) showing positions 1 and 3 closed and positions 2 and 4 open to ion flow.

Figure 3:
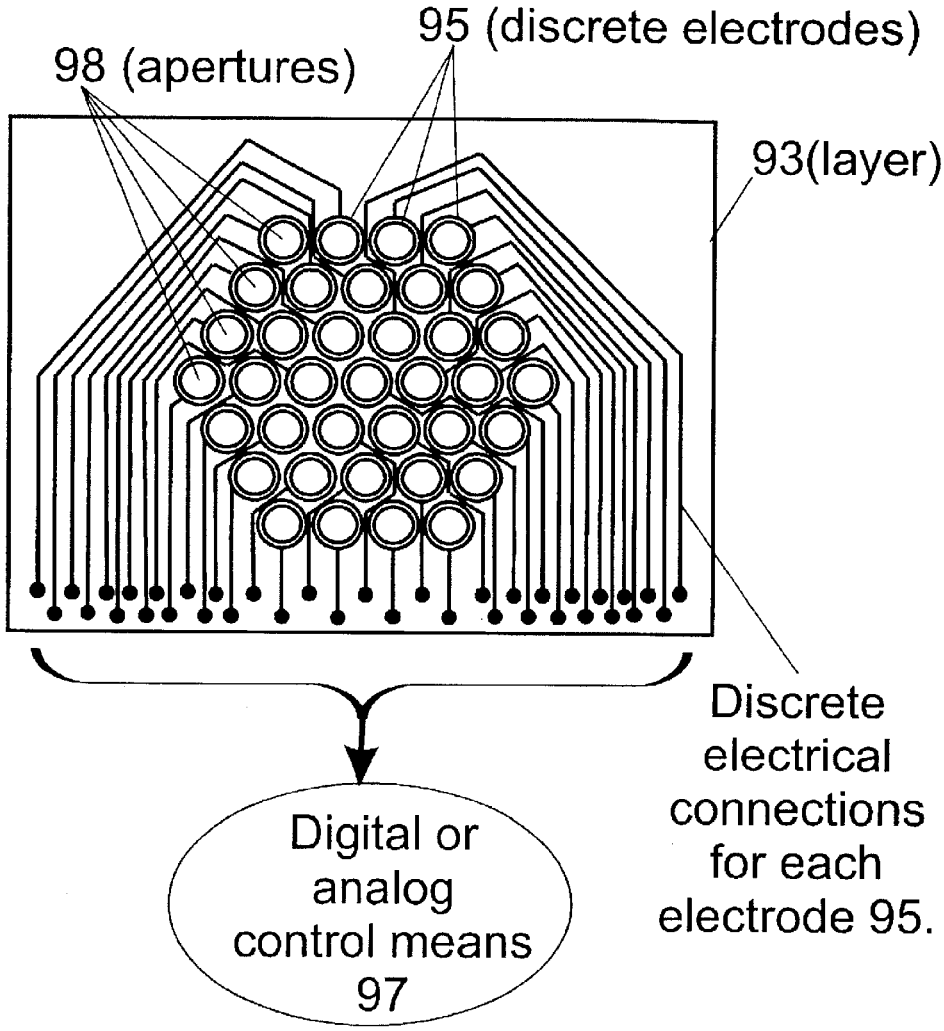

FIG. 3 shows a laminated high-transmission element (L-HTE) comprised of three metal laminates described in FIGS. 2A and 2B with digital or analog control.

FIGS. 4A to 4D shows cross-sectional illustrations of various shapes of a laminated high-transmission element (L-HTE) with the base partially removed between the two metal laminates (A) hemispherical-shaped laminated high transmission element, (B) conical-shaped laminated high transmission element, (C) tubular-shaped laminated high transmission element, (D) planar-shaped laminated high transmission element.

Figure 5B:
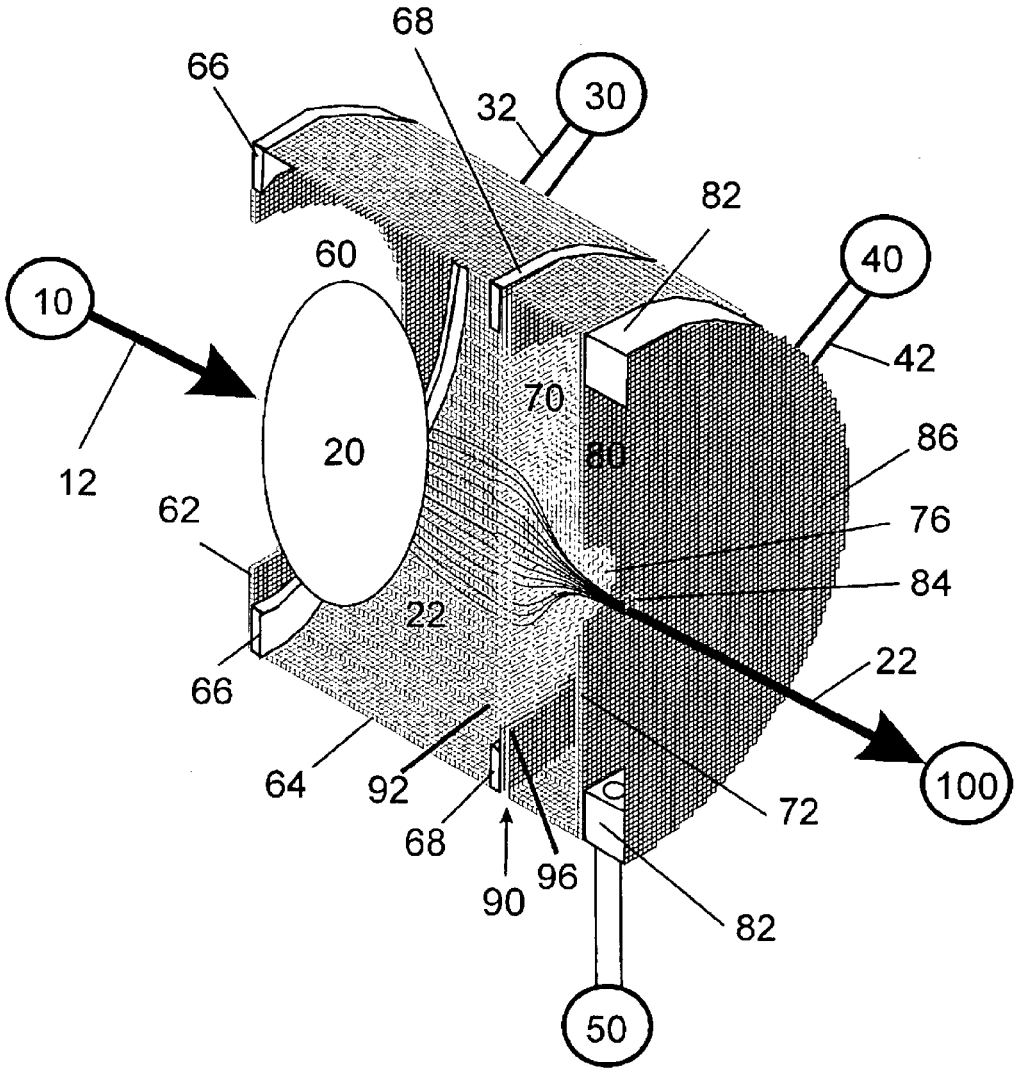
Figure 5C:
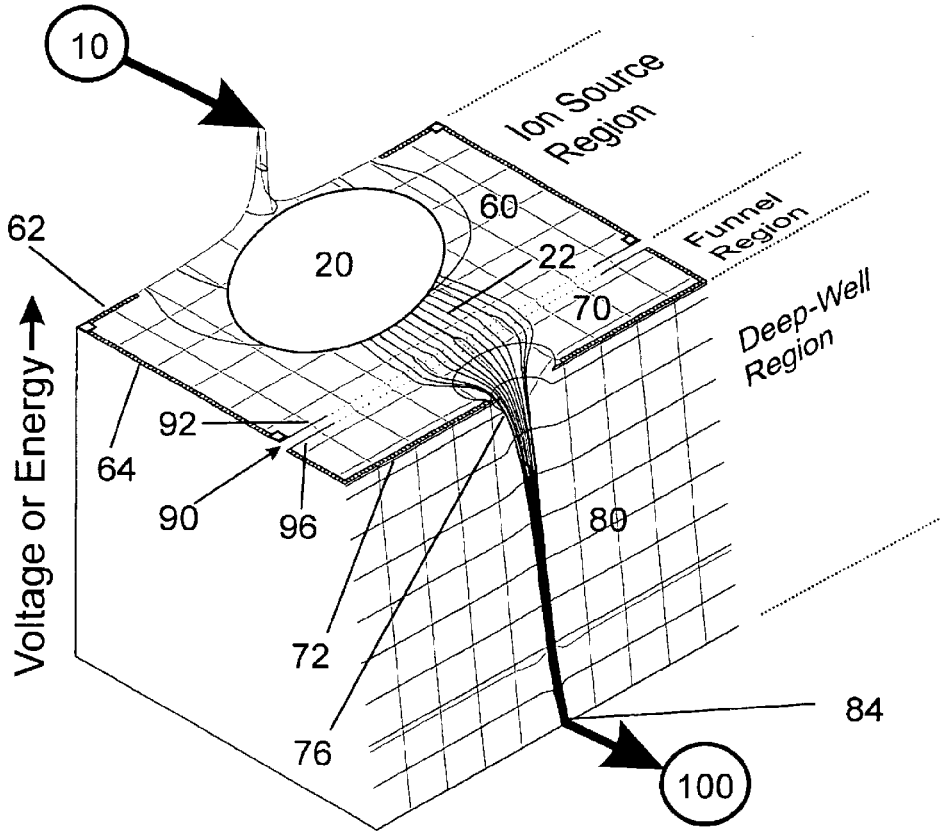

FIGS. 5A to 5C shows a laminated high-transmission element (L-HTE) (A) a cross-sectional illustration showing the focusing of ions from the ion source region, through the laminated element and subsequent transmission through an exit aperture, (B) a 3-dimensional cutaway of the device, (C) potential energy surface of the device showing the Ion Source, Funnel, and Deep-Well Regions.

Figure 6A:
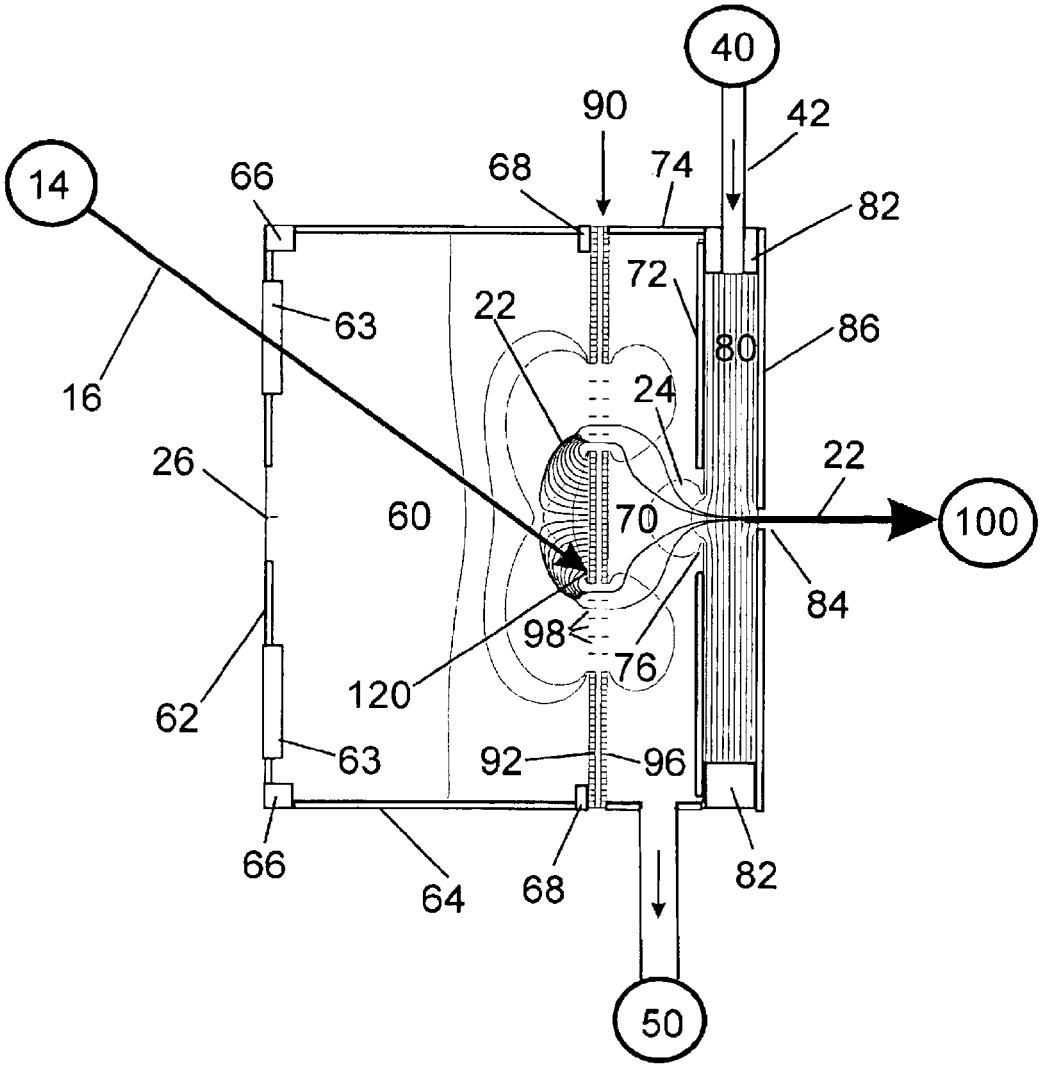
Figure 6B:
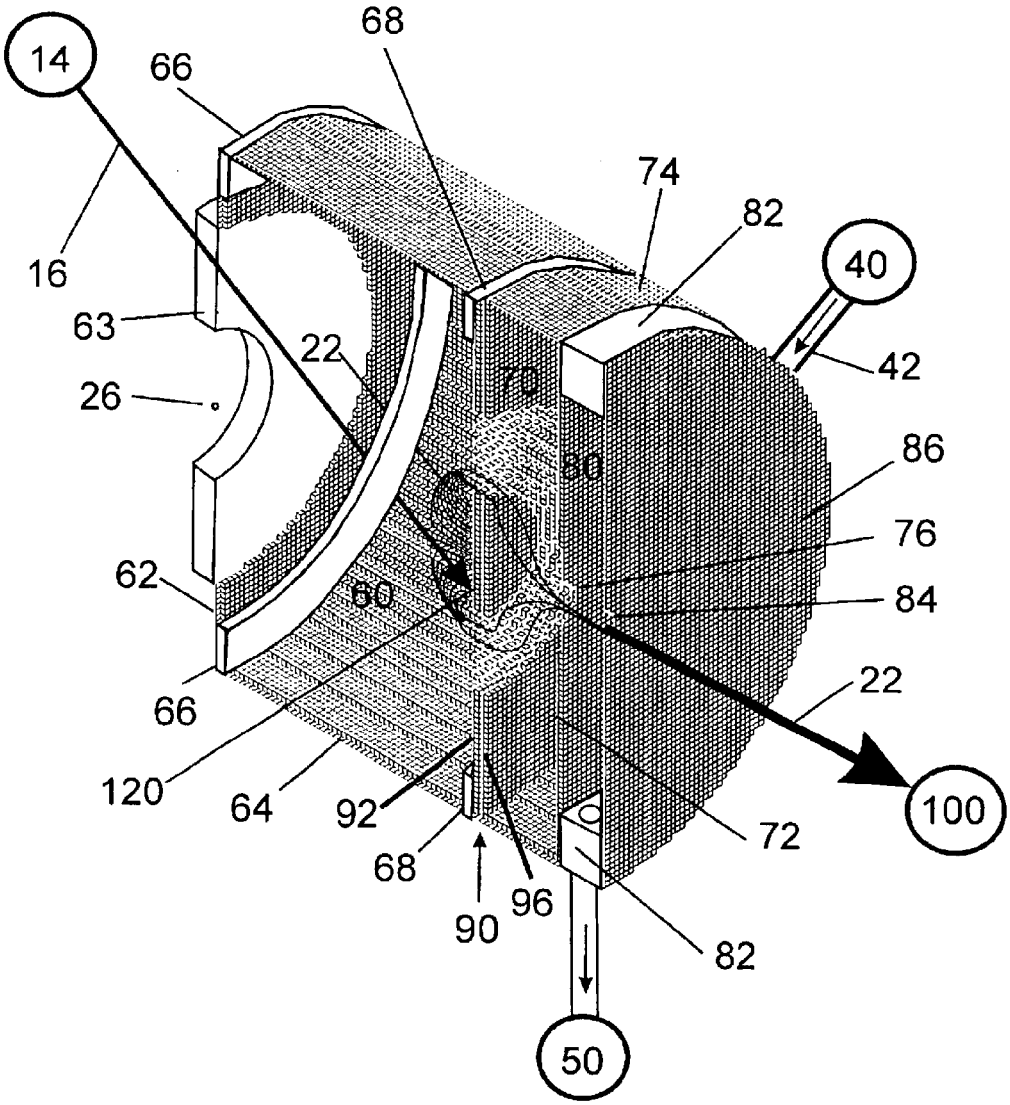
Figure 6C:
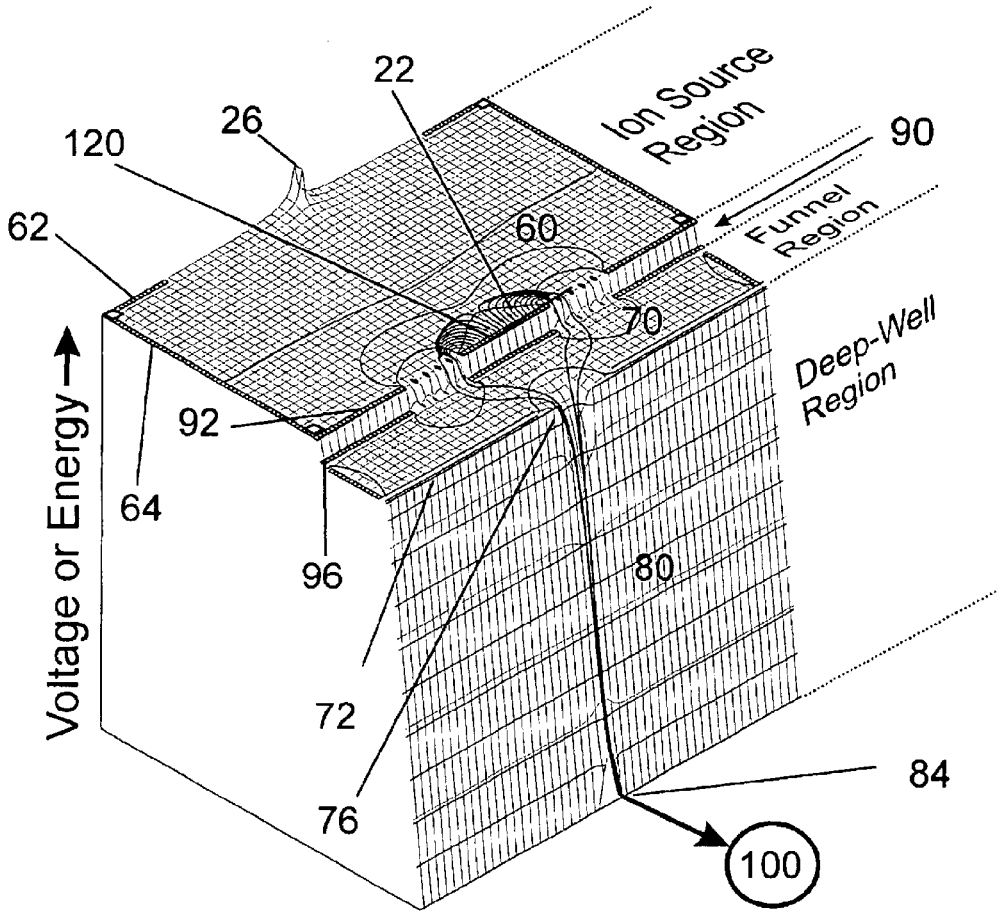
Figure 7A:
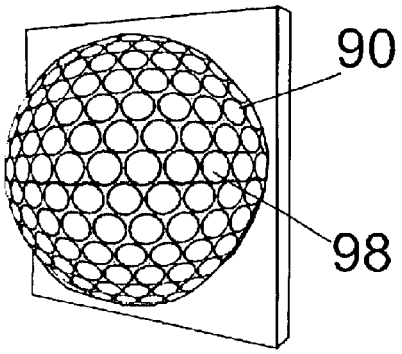
Figure 7B:
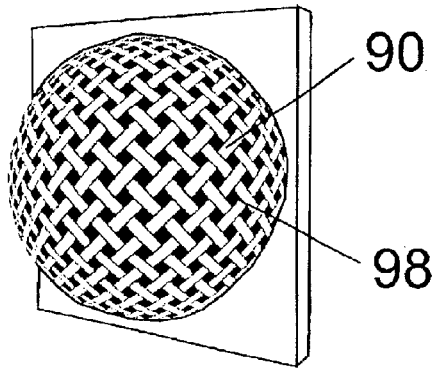
Figure 7C:
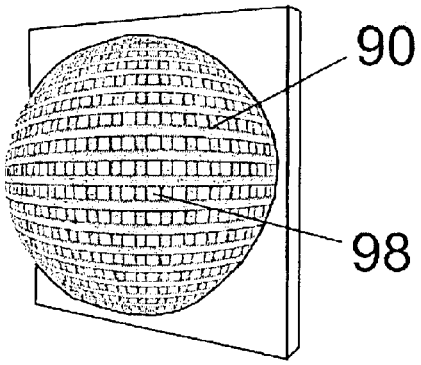
Figure 7D:
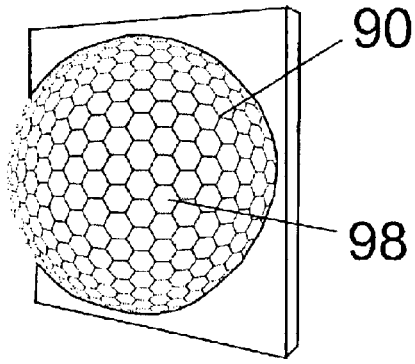
Figure 7E:
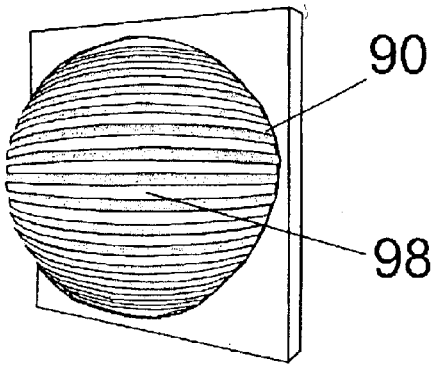
Figure 7F:
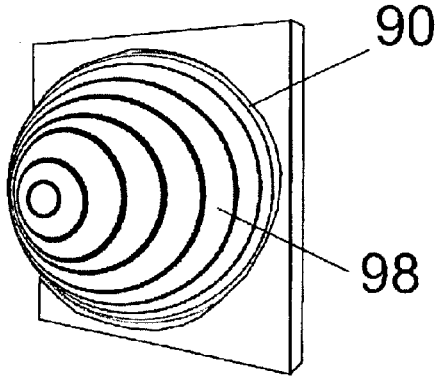

FIGS. 6A to 6C shows a laminated high-transmission element (L-HTE) where one of the metal laminates is also used as atmospheric-matrix-assisted laser desorption (AP-MALDI) target (A) a cross-sectional illustration showing the focusing of desorbed ions desorbed from the ion source region, through the laminated element and subsequent transmission through an exit aperture, (B) a 3-dimensional cutaway of the device, (C) a partial view of the potential energy surface of the device showing the Ion Source, Funnel, and Deep-Well Regions.

FIGS. 7A to 7F show perspective views of six hemispherical shaped laminated high-transmission elements (L-HTE); showing the outer or upstream metal laminate (A) sheet metal with circular openings, (B) woven wire elements with square or rectangular openings, (C) cross-hatched wire electrodes showing similarly shaped openings, (D) stamped sheet metal with hexagonal apertures, (E) parallel wires with transverse slots or openings between individual wires, and (F) concentric wire hoops or rings with radial slots or openings.

REFERENCE NUMBERS IN DRAWINGS

| | |
|---|---|
| 10 | sample source |
| 12 | sample delivery means |
| 14 | laser source |
| 16 | incident laser beam |
| 20 | ion source |
| 22 | ion trajectories |
| 24 | equipotential lines |
| 26 | needle electrode |
| 30 | concurrent gas source |
| 32 | concurrent gas inlet |
| 40 | countercurrent gas source |
| 42 | countercurrent gas inlet |
| 50 | exhaust destination |
| 52 | exhaust outlet |
| 60 | ion source region |
| 62 | ion source entrance wall |
| 63 | window |
| 64 | ion source cylindrical wall |
| 66 | insulator ring |
| 68 | insulator ring |
| 70 | funnel region |
| 72 | funnel lens or electrode |
| 74 | funnel region wall |
| 76 | funnel aperture |
| 80 | deep-well region |
| 82 | deep-well ring insulator |
| 84 | exit aperture |
| 86 | exit wall |
| 90 | laminated-high transmission element (L-HTE) |
| 92 | inner-electrode |
| 93 | interior electrode |
| 94 | L-HTE insulation layer |

-continued

| | |
|---|---|
| 95 | discrete opening electrode |
| 95a | discrete opening electrode-position 1 |
| 95b | discrete opening electrode-position 2 |
| 95c | discrete opening electrode-position 3 |
| 95d | discrete opening electrode-position 4 |
| 96 | outer-electrode |
| 98 | laminate openings |
| 97 | external control means |
| 100 | ion destination region |
| 120 | MALDI target disk |

DESCRIPTION

FIGS. 5A–5C—Perferred Embodiment

[Laminated Focusing Device With Two Metal Laminates]

A preferred embodiment of the present invention is an ion or particle transmission and focusing device utilizing a laminated high transmission element, atmospheric lens or just abbreviated as L-HTE 90 as illustrated in FIGS. 5A–C. Sample from a source 10 is delivered to an ion source 20 by a delivery means 12 through an ion source entrance wall 62. Wall 62 is electrically isolated from an ion source cylindrical wall 64 by a ring insulator 66. Wall 64 is isolated from the L-HTE 90 by a ring insulator 68. The device includes an atmospheric pressure or near atmospheric pressure ion source region 60 from which ions originating from the source 10 are delivered or, alternatively, neutral species are ionized in the ion source 20. This device is intended for use in collection and focusing of ions from a wide variety of ion sources; including, but not limited to electrospray, atmospheric pressure chemical ionization, photo-ionization, electron ionization, laser desorption (including matrix assisted), inductively coupled plasma, discharge ionization, charged aerosols and ions sampled from nature, etc. Alternatively the ions may be supplied by ion separating or focusing devices; including, but not limited to ion mobility spectrometers.

Downstream of the ion source region 60 is the L-HTE 90, composed of laminations comprising inner-92 and outer-96 laminates, surfaces, or electrodes, both conducting separated by an insulator layer or base 94. The surface of the L-HTE 90 is populated with a multitude of lamination openings or apertures 98 through which ions are transmitted from the ion source region 60 to an ion funnel region 70 which is downstream of the L-HTE 90. Funnel region 70 is bounded by a funnel region wall 74 and a funnel region lens 72. A DC potential is applied to each laminate, electrode, wall, or lens creating an electric field (indicated by equipotential lines 24), although a single power supply in conjunction with a resistor chain can also be used, to create the desired net motion of ions, as shown by the generalized ion trajectories 22, from the ion source region 60, through the openings 98 of the L-HTE 90, into the ion funnel region 70, through a funnel lens aperture 76 into a deep-well region 80 where they are accelerated toward an exit aperture 84 in an exit wall 86 to an ion destination 100. Exit wall 86 is isolated from the funnel lens 72 by a deep-well ring insulator 82. Exit wall 86 is made of a conducting material or a conductively coated insulating material such as glass. In the case of vacuum detection, such as mass spectrometry in region 100, typical aperture diameters are 100 to 500 um. The destination region 100 in this embodiment is intended to be the vacuum system of a mass spectrometer (interface stages, optics, analyzer, and detector) or other low-pressure ion and particle detectors.

Gases, such as but not limited to air or nitrogen can be added to the ion source region 60 for concurrent flow gas from a concurrent gas source 30 introduced through a concurrent gas inlet 32. Gas can also be added for countercurrent flow from a countercurrent gas source 40 through a countercurrent gas inlet 42. Alternatively, gas flowing in the concurrent and countercurrent direction may be added to the ion source region 60 and ion funnel region 70 by introducing the gas between inner-92 and outer-96 laminates, the gas flowing out of the openings 98 into the respective areas. Excess gas can be exhausted through an exhaust outlet 52 toward an exhaust destination 50. All gas supplies can be regulated and metered and of adequate purity to meet the needs of the ion transmission application.

All components of the device are generally made of chemically inert materials. In the preferred embodiment, the L-HTE insulator base 94 is an insulating material, such as glass or ceramic. However, it can consist of any other material that can isolate electrically the two metal electrodes 92, 96 from each other, such as nylon, polyimide, Teflon, poly ether ether ketone (PEEK), etc. The metal electrodes, 92, 96, are composed of conductive materials, such as stainless steel, brass, copper, gold, and aluminum. In this embodiment the L-HTE 90 consist of planar-shaped laminated electrodes 92, 96 of uniform cross-section with circular-shaped openings 98 evenly spaced across the L-HTE 90. Two perforated plates separated by an insulated layer are workable for the planar geometry, but for other shapes or geometries it is also possible to use molded materials for the base 94 and laminates 92, 96, with the laminates consisting of material that is conducting or as non-conducting molded materials with subsequent deposition of conducting material on the surfaces of the laminates. Alternatively, the metal laminates may be deposited on the base 94 by vapor deposition and the holes or apertures formed by ablating away the metal and base using a laser, or the L-HTE may be manufactured by using the techniques of microelectronics fabrication: photolithography for creating patterns, etching for removing material, deposition for coating the surfaces with specific materials, etc.

FIGS. 2, 3, and 6—Additional Embodiment

[Multiple Metal Laminates and Back-well AP-MALDI]

Additional embodiments are shown in FIGS. 2, 3, and 6, in one case the L-HTE consists of three metal laminates, and the other where a MALDI target is incorporated into the structure of the L-HTE. In FIGS. 2A, 2B, and 3 the L-HTE consists of three metal electrodes, with a interior laminate or electrode 93 sandwiched between electrodes 92, 96. The internal electrode 93 is made up a multitude of individual electrodes, 95A, 95B, 95C, etc. isolated from each other and electrodes 92, 96 by the insulating base 94. A digital or analog control means 97 controls the electric potential of the individual electrodes.

In FIGS. 6A and 6B the present invention incorporates a laser source 14 and the use of an incident laser beam 16 to desorb MALDI samples from a MALDI target disk 120 that is incorporated into the inner-electrode 92 of the L-HTE 90. Region 60 can be either open to the atmosphere or closed with access to the target 120 through a window 63. In this embodiment, a needle electrode 26, axial with the L-HTE 90, incorporated in the ion source entrance wall 62 or alternatively the wall can be completely eliminated leaving just the needle electrode projecting into the ion source region 60.

Figure 4:
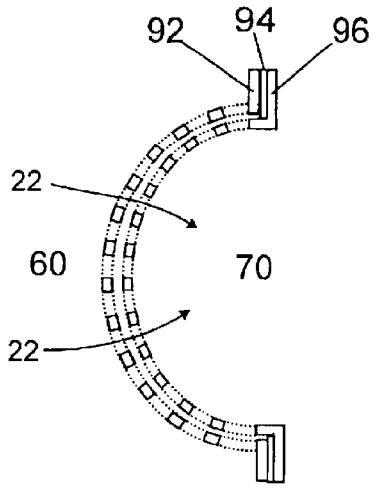
Figure 4:
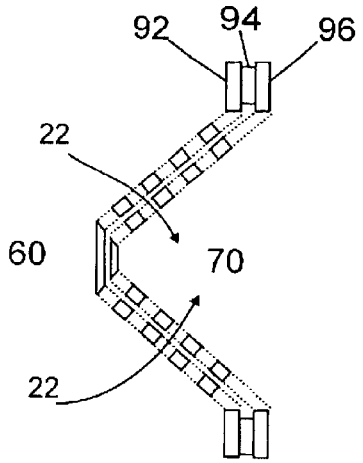
Figure 4:
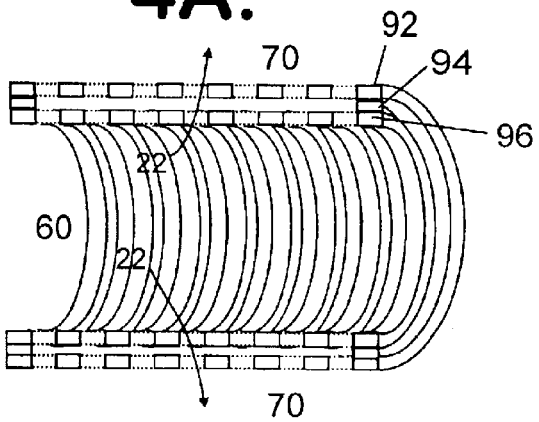
Figure 4:
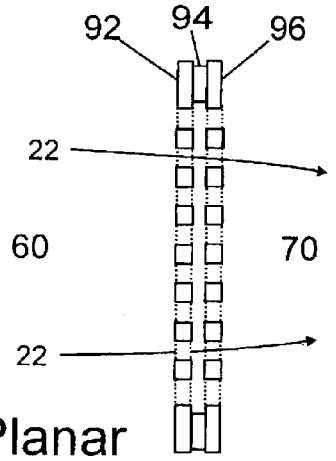

FIGS. 4 and 7—Alternative Embodiments

[Manufacturing, Shapes, and Patterns]

There are various possibilities with regard the geometry and shape of the laminated high-transmission element and disposition of the insulating layer, as illustrated in FIG. 4; in each case the insulation layer 94 is not continuous between the metal laminates. FIG. 4A shows a set of hemisphere-shaped electrodes 92, 96; FIG. 4B shows a set of conical-shaped electrodes 92, 96; FIG. 4C shows a set of tubular-shaped electrodes 92, 96; FIG. 3D shows a set of planar-shaped electrodes 92, 96; and a wide variety of geometries can be implements as geometric barriers between one or more ion regions and/or one or more ion destinations.

Alternatively, there are various possibilities with regard to the shape of the laminated openings, as illustrated in FIG. 7 for hemi-spherical-shaped L-HTE where the openings in one laminate are optically aligned with openings in the other, and uniformly spaced in order to meet the field penetration, transmission, and isolation requirements of a particular application. FIG. 7A shows a hemispherical-shaped L-HTE 90 made of perforated metal with circular-shaped openings 98; FIG. 7B shows a hemispherical-shaped L-HTE 90 made of woven metal with rectangular or square-shaped openings 98; FIG. 7C shows a hemispherical-shaped L-HTE 90 made of cross-hatched metal with rectangular or square-shaped openings 98; FIG. 7D shows a hemispherical-shaped L-HTE 90 made of hexagonal metal with hexagonal-shaped openings 98; FIG. 7E shows a hemispherical-shaped L-HTE 90 made of parallel array of wires with slotted or rectangular-shaped openings 98; FIG. 7F shows a hemispherical-shaped L-HTE 90 made of concentric metal hoops or rings with slotted or rectangular-shaped openings 98.

Operation of the Basic Device—FIGS. 1 and 5

The L-HTE 90 in operation is placed between the ion source and the ion destination to isolate the processes of ion generation from ion collection, analysis, or detection without significant transmission losses. The potentials of the electrodes 92, 96 are adjusted to control transmission. Ions supplied or generated from an atmospheric pressure source are attracted to the L-HTE 90 by an electrical potential difference between the ion source region 20 and the potential on inner-electrode 92 of the L-HTE 90. The ions will tend to follow the field lines through region 60. We distinguish regions 20 and 60 in that the ion source region 20 may comprise a plasma with ill-defined or uncontrollable fields. Region 60 contains gas such as air or nitrogen below the threshold for discharge ionization and fields defined by the shape and potential on L-HTE 90. The ions moving toward inner-electrode 92 are diverted away from the conducting surfaces of the inner-electrode through the openings 98 by the presence of the electrical field penetrating through the openings into the part of region 60 that is close to the inner-electrode 92. This field penetration is due to the potential difference between the inner-92 and the outer-electrode 96 being relatively high. As the ions move into the openings they are compressed toward the axis of openings 98. FIG. 1A illustrates the motion of ions through the L-HTE 90 when the fields on either side of the L-HTE are equal and transmission is virtually 100%. When the field on the ion source region 60 side is substantially higher than the field in the ion funnel region 70 side, many ions impact on the surface of the outer-electrode 96 (back-deposition) as shown in FIG. 1B. To overcome transmission losses due to this unfavorable field ratio, a concurrent flow of gas can be added to prevent back-deposition (as shown in FIG. 1C) and thus maximize transmission of ions through the L-HTE into the ion funnel region 70.

The device illustrated in FIGS. 5A and B operates by generating ions or collecting ions in the ion source region 60. The ions are accelerated away from the ion source region, toward and through the L-HTE 90 into the funnel region 70 of the device where ions are focused through the funnel aperture into the deep-well region where a well-collimated and highly compressed beam of ions is delivered to the ion destination region 100. FIG. 5C displays the potential-energy surface plot showing the relative potential of each component of the operating system. In general, the ions flow form a dispersive, high-field source region, across the L-HTE 90 with local high-fields to nudge the ion through the openings and through the L-HTE, into and through the funnel-shaped focusing fields of the funnel region 70, and into the deep potential well of the deep-well region 80. The general operation is simply to isolate the focusing regions 70, 80 from the dispersive ion source region 60 in order to maximize compression and collection while minimizing transmission losses.

The ion destination region 100 can be a mass spectrometer, MS/MS, IMS, and any other ion or charged particle detection and analysis device. Alternatively, this device may be operated as a collection and focusing device to move gas-phase ions and charged particulate materials from diffuse atmospheric sources onto small focal areas of collector surfaces. We envision applications for laying down materials in printing, semiconductor, micro-chemistry applications, etc. In addition, this device can operate to collect sample onto surfaces for subsequent surface analysis (e.g. depositing sample onto MALDI targets, SIMS targets, or X-ray targets). In addition, collecting material onto surfaces of reaction wells may allow for gas-phase ion production to be a useful tool for placing charge chemical species into a discrete and small reaction well in application, such as collecting and specifying complex reagents and reactant for applications in combinatorial chemistry.

The flow of gas in a direction that is counter to the movement of ions will serve to reduce or eliminate contamination from particulate materials and neutral gases. Operating with a counter-flow of gas is accomplished by adding sufficient flow to purge or remove unwanted materials. This to some extent will have some dependency on the volatility of neutral gases and the size of interfering particulate material originating from the ion source region 60. Lower mobility charged particles may also be swept away in the counter-flow of gas. In some cases, a combination of gas following concurrent to the motion of ions to improve transmission through the L-HTE and gas flowing counter-current to remove impurities may be required. When using gas flowing in opposite directions the counter-flow of gas is likely to occur through the funnel aperture 76.

Operation of the of Multiple Source Devices

The operation of the present invention can accommodate the collection of ions from more than one source. This multi-source device operates under the same principles as a single-source device but the ion source region 60 is occupied by more than one ion source. This can have application for devices with both APCI and electrospray ion sources present in the same ion source region either spraying simultaneously or alternating back and forward in a pre-determined manner. In addition, electrospray needle arrays are also becoming commercially available for high-throughput sample analysis, discrete introduction of mass calibration standards, etc.; sampling the spray from an electrospray needle array one needle at a time. Alternatively, a laser can desorb a series of samples from individual targets one target at a time. Operation with more than one source can also occur with selective sampling of ions from a desired source through one region of the L-HTE while rejection ions from another source in a second region of the same L-HTE. Thereby operating the L-HTE as an ion switch, selecting one sample stream then another.

Operation of the of Multiple Collector or Target Devices

This invention may also operate in a mode whereby the ions from a single ion source region 60 are collected and focused across multiple L-HTE with multiple discrete collection regions. This mode is useful for delivering ions from a single source to multiple focal points or apertures for sampling and eventual analysis or delivering to multiple targets. A single ion source with two or more L-HTE and companion targets up to a large array of L-HTE and target foci can have application in a wide variety of areas including loading reagents onto reaction wells, printing, microfabrication, semi-conductor manufacturing, etc.

Operation of the Three Layer Device—FIGS. 2 and 3

The L-HTE can be used to selectively transmit ions through pre-selected openings by incorporating a third metal laminate. As shown in FIGS. 2A, 2B, and 3 when an additional metal laminate is added to the L-HTE, the transmission of ions can be selectively blocked or transmitted across the L-HTE. The inner-92 and outer-electrode 96 serve in much the same way as the two-layer laminate. This embodiment has an interior electrode 93 comprised of a large number of individually isolated aperture electrodes (represented as 95*a* through 95*d* for aperture position 1 through 4 respectively) that can be individually controlled in time and electrical potential. These electrodes provide a means to produce a potential barrier at each discrete opening in the L-HTE surface. Each discrete opening electrode 95 has an electrical connection to the external control means 97. These electrodes can be controlled both individually and in groups or clusters depending on the application and the spatial resolution requirement for transmission of the intended application. This control can be either analog or digital, utilizing digital control for high-speed control applications. Thereby allowing for the transmission of ions to be temporally and spatially controlled over the surface of the L-HTE. This more complex embodiment has application in delivering ions from a source to a precisely determined spatial position, for example the L-HTE can be used for laying down samples onto MALDI targets or laying down reagents into microchip arrays. Alternatively, it can be sued for laying down complex patterns for very precise microprinting, coating applications, etc. It should also be noted that the pattern of ions generated by this gating process can be subsequently focused and compressed by various optical configurations.

Operation of the of Atmospheric MALDI Device—FIG. 6

The operation of the atmospheric pressure-MALDI (AP-MALDI) source illustrated in FIGS. 6A thru 6C is fundamentally the same as the general operation with several important exceptions. FIGS. 6A and 6B illustrate two views of an AP-MALDI source with the MALDI samples directly deposited on the surface of the inner-electrode. Samples can be applied directly to the surface, or, more conveniently onto the conducting sample disk 120 that attaches co-planar and makes electrical contact to the inner electrode. In this fashion, MALDI samples are desorbed from the surface by application of incident the laser beam 16 from the laser source 14. Once desorbed, the ions proceed on trajectories that wrap around the sample plane, traversing the L-HTE 90; and are funneled and compressed in a similar fashion as described in the preferred embodiment. In this embodiment, a ring of slotted openings (laminated openings 98) around the target area provides the necessary field penetration for accelerating the ions away from the target and subsequent transmission through the openings. The optional needle electrode 26 in region 60, on axis with the MALDI target can be operated to control the degree of field penetration from the L-HTE into region 60. FIG. 6C shows a close-up of the potential-energy surface on this device illustrating the position of the deep-well downstream of the sample, thus designating this embodiment as "back-well" AP-MALDI.

CONCLUSION, RAMIFICATIONS, AND SCOPE

Although the description above contains many specifications, these should not be construed as limiting the scope of the invention but as merely providing illustrations of some of the presently preferred embodiments of this invention. For example complex shapes and patterns can be deposited by tailoring the shape of the L-HTE or the shape, pattern, or spatial orientation of the individual openings in the separate metal laminates; insulator surfaces can be manufactured by using the techniques of microelectronics fabrication; photolithography for creating patterns, etching for removing material, and deposition for coating the base with specific materials; the number of laminates and the size and shape of the individual openings can vary depending on the source of ions, the extent of using concurrent and countercurrent gas flow, the type of ion-collection region or a combination of both, etc.

Thus the scope of the invention should be determined by the appended claims and their legal equivalents, rather than by the examples given.

What is claimed is:

1. Apparatus for the collection and focusing of gas-phase ions or particles or droplets or combinations thereof, at or near atmospheric pressure, the apparatus comprising:

a. a dispersive source of ions;

b. a lens populated with a plurality of openings through which said ions pass unobstructed into a focusing region, said lens consisting of an insulating body of material, said insulating body having a topside and an underside, said insulating body has a layer of metal laminated on said topside and said underside that are contiguous with said insulating body, said metal laminate on said topside of said insulating body is adjacent to said ion source, said metal laminates being supplied with attracting electrostatic direct current potentials by connection to a voltage supply, and generating an electrostatic field between said source of ions and said metal laminates;

c. a target surface, downstream of said lens for receiving said ions, said target surface held at a higher strength electrostatic direct current potential by connection to said voltage supply, and generating an electrostatic field between said metal laminates of said lens and said target surface, which has field lines that are concentrated on a relatively small cross-sectional area of said target surface;

d. an funnel lens or electrode sandwiched between said lens and said target surface for focusing said ions exiting into said focusing region through said openings in said lens into a deep-well region interposed between said funnel lens and said target, said funnel lens held at an electrostatic direct current potential, whereby electrostatic field lines are focused through a central opening in said funnel electrode and towards a small cross-sectional area on said target surface, thereby focusing approximately all said ions onto said small cross-sectional area.

2. The apparatus in claim 1 wherein said openings in said lens are at least 0.1× in diameter as said central opening in said funnel electrode.

3. The apparatus as in claim 1 wherein said target surface for receiving said ions, has a target aperture or tube with said electrostatic field lines concentrated on a relatively small cross-sectional area of said target aperture or opening of said target tube.

4. The apparatus as in claim 3 wherein said target tube comprises a conductive end of a capillary tube.

5. The apparatus as in claim 3 further including an analytical apparatus in communication with said target aperture or tube, wherein said target aperture or tube is interposed between said funnel electrode and said analytical apparatus, said small cross-sectional area of ions being directed through said target aperture or said opening of said target tube into said analytical apparatus.

6. The apparatus as in claim 5 wherein said analytical apparatus comprises a mass spectrometer or an ion mobility spectrometer or a combination thereof.

7. The apparatus of claim 1 wherein said funnel electrode is held at the same electric potential as said metal laminate on said underside of said insulating body of said lens.

8. The apparatus as in claim 1 wherein said gas-phase ions are formed by means of atmospheric or near atmospheric ionization.

9. The apparatus as in claim 8 wherein said atmospheric or near atmospheric ionization source is comprised of an electrospray, atmospheric pressure chemical ionization, atmospheric laser desorption, photoionization, discharge ionization, inductively coupled plasma ionization source, or a combination thereof.

10. The apparatus of claim 8 wherein said atmospheric or near atmospheric ionization source is made up of a plurality of said atmospheric or near atmospheric ion sources operated simultaneously or sequentially.

11. The apparatus of claim 1, wherein said target surface, is made up of a plurality of target apertures or tubes aligned with a plurality of focal points, said multiple focal points resulting from mechanical variations of said funnel electrode's position, shape, or a combination thereof; ions or charged particles focused and concentrated at said focal points for collection or passed through openings in said target apertures or tubes for analysis.

12. The apparatus in claim 1 further including an ion source cylindrical wall or electrode surrounding the circumference of said lens; said cylindrical electrode held at an electrostatic potential the same or slightly above the potential on said metal laminate on topside of said insulating body adjacent to said source of ions, said cylindrical electrode functioning to shield said metal laminate on the topside of said lens from high electrostatic fields found in some needle containing atmospheric or near atmospheric ion source regions that suppress electrostatic field penetration from said metal laminate on the underside of said insulating body into said ion source regions.

13. The apparatus in claim 1 including a first gas supplied into said deep-well region between said target surface and said funnel lens, or into said focusing region between said funnel electrode and said lens whereby substantially all said gas flows into said focusing region and through said openings in said lens into said ion source region assisting the focusing of said ions into said openings in said lens, as said ions moved from said ion source region toward said lens.

14. The apparatus in claim 1 further including a second gas supplied into said ion source region, whereby substantially all said gas flows into said ion source region through said lens, assisting the focusing of said ions as they exit said openings in said lens into said focusing region.

15. The apparatus in claim 1 further including a gas supplied between said metal laminates in said lens, whereby substantially all said gas flows through said openings in said metal laminates on topside and underside, assisting the focusing of said ions as they enter and exit said openings.

16. The apparatus in claim 1 further including a gas exhaust between said lens and said funnel electrode for evacuating gas, whereby at least some of said gas in said focusing region flows into said gas exhaust.

17. Apparatus for the collection and focusing of an aerosol of gas-phase charged particles or droplets from an atmospheric or near atmospheric pressure ion source, the apparatus comprising:

a. a dispersive source of said charged particles or droplets;

b. a laminated lens populated with a plurality of openings through which said aerosol of charged particles pass unobstructed into a focusing region, said lens having a topside and an underside, said lens consisting of a central electrode, said central electrode is laminated on both sides with alternating layers of insulating material and metal laminate, said insulating material is contiguous with said central electrode and said metal laminates, said metal laminate on the topside of said lens is downstream of said source, said central electrode and metal laminates supplied with attracting electric potentials, and generating an electric field between said atmospheric ionization source and said metal laminate on the top side of said lens;

c. a target surface downstream of said lens for receiving said charged particles, said target surface being supplied with an ion-attracting and higher strength electrostatic potential, and generating an electrostatic field between said metal laminate on the underside of said lens and said target surface whereby electrostatic field lines are concentrated to a small cross-sectional area on said target surface;

d. an funnel lens or electrode disposed between said metal laminate on underside of said lens and said target surface for focusing said charged particles in said focusing region into a deep-well region, said funnel lens being supplied with an electrostatic direct current potential, whereby approximately all said charged particles in said focusing region are focused into said deep-well region and onto said target surface;

e. a first gas supplied into said deep-well region between said target surface and said funnel electrode, whereby substantially all said gas flows into said focusing region;

f. a second gas supplied into said ion source region, whereby substantially all said gas flows into said ion source;

g. a gas exhaust for evacuating said gases in said focusing region, whereby at least some of said gas flows into said gas exhaust.

18. The apparatus of claim 17 wherein said electric potential of said central electrode is a combination of radio frequency (RF) and direct current (DC) voltages.

19. The apparatus of claim 17 wherein said atmospheric or near atmospheric ionization source is comprised of an electrospray, atmospheric pressure chemical ionization, atmospheric laser desorption, photoionization, discharge ionization, or inductively coupled plasma ionization source.

20. The apparatus of claim 17 wherein said atmospheric or near atmospheric ionization source is made up of a plurality of sources.

21. The apparatus of claim 17 wherein said target surface is made up of a plurality of targets whereby position and time dependence of focal points of said small cross-sectional area are determined by variation in said inner field-shaping electrode's geometry, position, potential, or a combination thereof.

22. Method for the transfer of charged particles or ions or combination thereof from a highly dispersive area or ion source at or near atmospheric pressure and focusing approximately all said charged particles or ions into an inlet aperture for gas-phase ion analysis, the method comprising:

a. providing electric urging to said charged particles or ions with electric fields provided by a laminated lens with alternating laminates of insulating and metal layers, populated with a plurality of openings contiguous with said laminates, metal laminates having ion drawing electric potentials, such that electrostatic field lines between said ion source and said metal laminates are concentrated into said openings;

b. transmitting approximately all said charged particles or ions from said ion source through said openings into a focusing region with electric fields generated between said metal laminates, wherein said openings possess a low depth aspect ratio, a high openness aspect ratio, and a high electric potential ratios between the said metal laminates;

c. providing electrostatic focusing to said charged particles or ions exiting said openings into said focusing region with a funnel lens or electrode focusing approximately all said ions in said focusing region into a deep-well region through a central opening in said funnel electrode, and directed towards said inlet aperture whereby approximately all said ions flow into a small cross-sectional area or focal point at the entrance of said inlet aperture.

23. The method of claim 22, wherein providing the transfer of said charged particles or ions from said dispersive ion source for gas-phase ion analysis, said laminated lens is comprised of a central insulating laminate, said central insulating laminate having a topside and underside, said central insulating laminate has a layer of metal laminated on said topside and underside that are contiguous with said central insulating laminate whereby a substantial fraction of said charged particle or ions or combination thereof are transmitted through said openings into said focusing region.

24. The method of claim 22, wherein providing the transfer of said charged particles or ions from said dispersive source for gas-phase ion analysis, said laminated lens is comprised of a central metal layer or laminate, said central metal laminate having a topside and underside, said central metal laminate has a layer of insulating material laminated on said topside and underside that are contiguous with said central metal laminate, in addition a set of metal laminates are laminated on said insulating laminates forming alternating layers of metal and insulating laminates on said central metal layer whereby a substantial fraction of said charged particle or ions or combination thereof are transmitted or not through said openings in said laminated lens into said focusing region by adjusting the electric potential, direct current (DC), varying current (RF), or a combination thereof, of said central metal laminate.

25. The method of claim 22, wherein providing the transfer of said charged particles or ions from said dispersive source for gas-phase ion analysis, comprises said inlet aperture at said focal point so that a substantial fraction of ions or particles at said focal point are transmitted through said inlet aperture to an analytical system such as a mass spectrometer or ion mobility spectrometer or a combination thereof.

26. The method of claim 22, wherein providing the transfer of said charged particles or ions from said dispersive sources for gas-phase ion analysis, said inlet aperture comprises a capillary inlet of an atmospheric pressure interface so that a substantial fraction of said ions or particles at said focal point are transmitted to a mass spectrometer or ion mobility spectrometer or a combination thereof.

27. The method of claim 22, wherein providing the transfer of said charged particles or ions from said dispersive sources for gas-phase ion analysis, comprises a plurality of said inlet apertures so that a substantial fraction of said ions at said focal points are transmitted to more than one gas-phase ion analyzer.

28. The method of claim 22, wherein providing the transfer of said charged particles or ions from said dispersive sources for gas-phase ion analysis, comprises a plurality of dispersive sources of said ions so that more than one said ion source may be sampled and a substantial fraction of said ions transmitted to said gas-phase ion analyzer.

29. The method of claim 22 further comprising feeding a gas between said inlet aperture and said funnel electrode into said deep-well region, whereby approximately all said gas passes into said focusing region and through said plurality of holes in said laminated lens into said ion source region, preventing a substantial fraction of larger particles or droplets, charged or uncharged or a combination thereof, from said ion source region from impacting on said laminated lens and possibly passing through said laminated lens in said focusing region.

30. Method for the transfer and focusing of charged particles or ions or combination thereof from a highly dispersive area or ion source at or near atmospheric pressure through a laminated lens, focusing approximately all said charged particles or ions into an inlet aperture for gas-phase ion analysis, the method comprising:

a. providing electric and viscous focusing to said charged particles or ions by said laminated lens with alternating laminates of insulating and metal layers, said laminated lens populated with a plurality of openings or conduits contiguous with said laminates, said electric focusing provided by metal laminates, while said viscous focusing provided by a flow of gas flowing through said openings into said ion source, such that approximately all said charged particles or ions are focused into said openings;

b. transmitting approximately all said charged particle or ions through said openings into a focusing region downstream of said lens by means of electric and viscous focusing, said electric focusing provided by electric fields generated between said metal laminates and said inlet aperture, while said viscous focusing provided by gas flowing through said openings into said focusing region;

c. focusing approximately all said charged particle and ions in said focusing region into a small cross-sectional area or focal point at the entrance of said inlet aperture.

* * * * *